United States Patent [19]

Dwyer

[11] 3,964,270

[45] June 22, 1976

[54] ICE MAKING MACHINE

[75] Inventor: Thomas A. Dwyer, Green Bay, Wis.

[73] Assignee: Liquid Carbonic Corporation, Chicago, Ill.

[22] Filed: Feb. 28, 1975

[21] Appl. No.: 554,394

[52] U.S. Cl. ..... 62/138; 62/158; 62/233

[51] Int. Cl.[2] ..... F25C 1/08

[58] Field of Search ..... 62/138, 158, 233

[56] References Cited

UNITED STATES PATENTS 3,277,661 10/1966 Dwyer ..... 62/348 X 3,850,005 11/1974 Sayles ..... 62/135

*Primary Examiner*—William E. Wayner

*Attorney, Agent, or Firm*—Robert W. Fiddler

[57] ABSTRACT

An automatic ice making machine having a control combining a timer with a thermostat to insure the attainment of desired temperatures in an ice forming enclosure and the retention of water in the ice forming enclosure for sufficient time to produce desired freezing at which time the control acts to automatically terminate the ice forming cycle and to initiate an ice harvesting cycle over recurring cycles of freezing and harvesting.

7 Claims, 9 Drawing Figures

ICE MAKING MACHINE

BACKGROUND OF INVENTION

This invention relates to the art of ice cube making machines, and, more particularly, to an improved control for ice making machines to automatically produce ice cubes over recurring cycles of freezing and harvesting.

Machines have been evolved which automatically produce ice cubes by going through sequential freezing and harvesting cycles. During the freezing cycle, the ice cubes are produced and during the harvesting cycle the cubes are discharged by the machine into a storage compartment. It is essential to operate such machines to accurately initiate and terminate the respective freezing and harvesting cycles to insure the formation of the desired cubes. To this end, a number of various control devices have been suggested for ice making machines.

Thus, in the machine disclosed in U.S. Pat. No. 3,009,336, a weight control is employed responsive to the weight of the water by-passed from the freezing chamber indicating that the chamber is full of ice, to initiate harvest.

Such previously evolved weight controls present problems in that the by-passed water is retained in a spring balanced pilot tank assembly which is relatively costly and requires excessive maintenance and adjustment.

Applicant, in his prior U.S. Pat. No. 3,277,661, attempted to eliminate the problems of the above described weight control by employing a thermostatic temperature responsive arrangement. However, in order to attain a desired mode of operation, it was necessary to employ two thermostats. One thermostat is responsive to a first relatively high temperature in the ice forming chamber indicative of the fact that there is no ice in the freezing chamber at which time the thermostat closes a switch to initiate the freezing cycle. The second thermostat is responsive to a given low temperature indicative of the fact that any water in the freezing chamber is frozen, at which time the thermostat closes a switch to initiate the harvest cycle. In applicant's prior patent, the first thermostat is disclosed as initiating the freezing cycle at a temperature of approximately 55° F. and at a temperature of approximately 30° F. acting to bring the second thermostat into the circuit. Thereafter, when the second thermostat senses a temperature of 10° F., the second thermostat initiates the harvest cycle.

Though the use of thermostatic controls eliminates the problems with the weight control, it is found that with aging, and irregularities in the ambient atmosphere in which the ice making equipment is located, relatively extensive servicing of the equipment is required to adjust and maintain the setting of the thermostats to obtain desired freezing. Such servicing requires the skills of trained mechanics, and can generally not be performed by the equipment owner.

Additionally, it is found that even where given temperatures are attained, desired freezing does not necessarily occur due to variations in water turbulence, and the physical and chemical nature of the water, so that adjustment or replacement of the thermostat does not always alleviate the problem.

BRIEF DESCRIPTION OF THE INVENTION

It is with the above considerations in mind that the present improved ice cube making machine has been evolved, employing a thermostat in combination with a manually adjustable variable interval timer to control machine operation to automatically and cyclically produce ice cubes.

It is an object of the present invention to provide an improved ice making machine having a simple relatively inexpensive and trouble free control device therefor.

Another object of the invention is to provide an ice making machine having a control device subject to simple selective adjustment without requiring the services of skilled mechanics.

These and other objects of the invention which will become hereafter apparent are attained by providing a control device which is adapted to be used in combination with an automatic ice making machine of the type having a freezing chamber which includes a plurality of individual ice forming compartments in heat exchange relationship with a refrigerant evaporator of a compression refrigeration system. The ice forming compartments have openings through which the formed ice is adapted to be discharged. A closure is provided for closing the discharge openings during the freezing cycle of the evaporator and for opening the discharge opening after the freezing cycle has been terminated, so that the ice can be harvested from the machine. Also provided are valves, one of which controls the flow of the fluid to be frozen to the compartments and another of which controls the flow of a refrigerant to the evaporator providing cold evaporating refrigerant during the freezing cycle, and hot refrigerant during the harvest cycle.

The control means includes a manually adjustable variable interval timer coupled to a thermostatically operated switch which is responsive to the temperature in the freezing chamber. When the temperature of the freezing chamber drops to a first level at which it is certain that fluid in the freezing chamber will freeze (e.g. 20° F.), the thermostatically operated switch closes a circuit to the timer which is set to maintain the freezing cycle for a period sufficient to insure complete freezing of all fluid in the freezing chamber. After the timer has run through its set timing interval, the apparatus cycles to the harvest cycle. The freezing cycle is terminated, the closure is moved away from the freezing chamber discharge openings, the hot gas defrost valve is opened, and the water supply valve is opened. The ice will then be harvested from the freezing chamber. Thereafter, when the temperature of the freezing chamber rises as a result of the hot gas sufficient to free the ice from the chamber, the thermostatic switch is operated to a second position, thereby energizing the actuator motor to move the closure means to close the discharge opening and again initiate the freezing cycle.

Accordingly, it is a feature of the present invention to provide an ice making machine having a simple, manually adjustable control means combining a thermostatic switch with a timer for automatically controlling the operation of an ice making machine, to insure that the water to be frozen is maintained at a freezing temperature for a period of time sufficient to form the desired ice.

BRIEF DESCRIPTION OF THE DRAWINGS

The specific details of a preferred embodiment of the invention and the best mode contemplated for practicing the invention will be described in full, clear and concise terms in conjunction with the accompanying drawings, wherein.

DESCRIPTION OF PREFERRED EMBODIMENT

Figure 1:
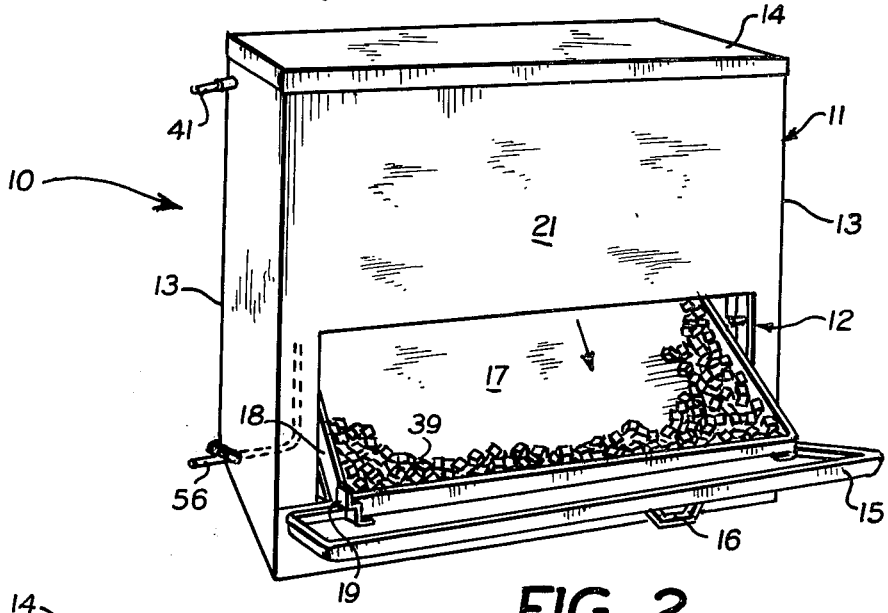
FIG. 1 is a perspective view of an ice making machine having the improved control means of the present invention therein.

The control device of the present invention is adapted to control the operation of an ice making machine similar to the type disclosed in the aforementioned U.S. Pat. No. 3,009,336 to Bayston et al, and U.S. Pat. No. 3,277,661 to Dwyer. Thus, as shown in FIG. 1, the automatic ice making machine 10 comprises an upper refrigeration section 11 and a lower ice storage section 12. The machine 10 is provided with side walls 13 and a top wall 14, which may be lined with a suitable insulating material (not shown). Ice storage section 12 is provided with a swinging insulated door 15 which is connected to machine 10 by suitable hinges (not shown). A handle 16 is provided to facilitate opening and closing door 15. The interior of ice storage section 12 comprises a bin 17 which receives and stores the ice manufactured in refrigeration section 11. Bin 17 is provided with a hinge arm 18 which is engaged by bracket 19 on the inner surface of door 15 to implement tilting the front of the ice bin to facilitate removal of the ice cubes from bin 17.

The refrigeration section 11 of the machine, as shown in FIGS. 2–5, is provided with a back wall 20, and side walls 13, and a front wall 21. Partition 22 divides the refrigeration section 11 into a freezing section 23 and a compressor section 24.

The ice forming enclosure or freezing chamber of automatic ice making machine 10 includes an ice forming evaporator unit 25 which comprises a top plate 26 and downwardly extending partitions 27 which form a plurality of individual open-button freezing cells 28.

Figure 2:
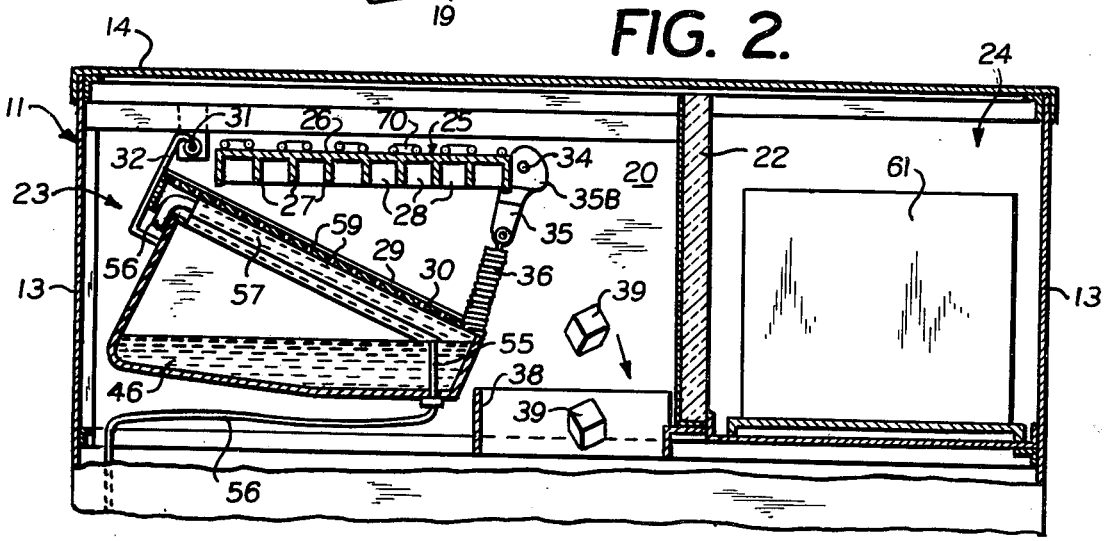
FIG. 2 is a vertical sectional view of the ice making machine shown in FIG. 1 during the harvest cycle.
Figure 3:
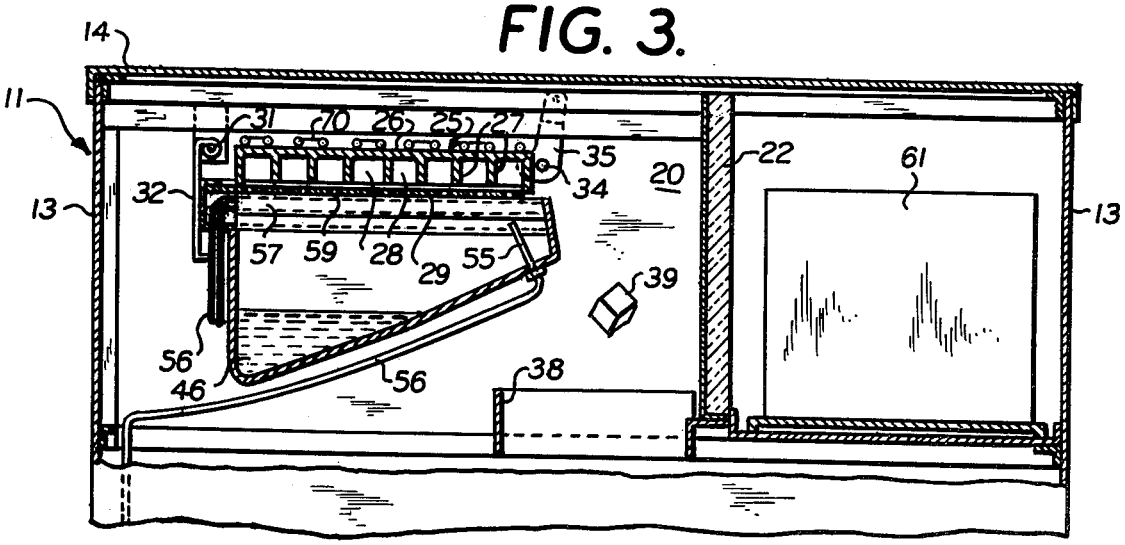
FIG. 3 is a vertical sectional view of the ice making machine shown in FIG. 1 during the freezing cycle.
Figure 4:
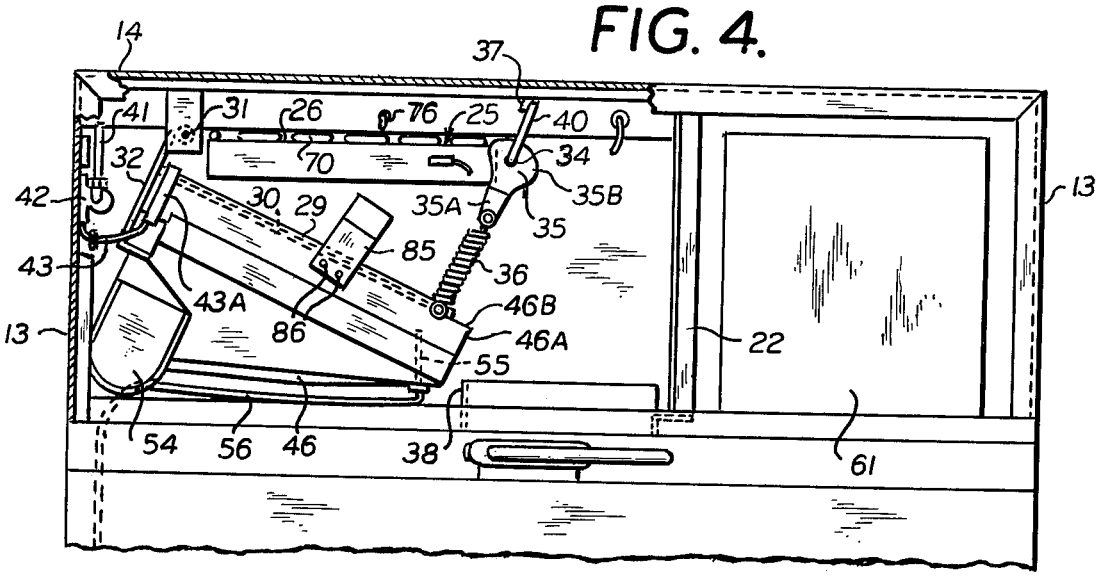
FIG. 4 is a front elevational view of the machine shown in FIG. 1 during the harvest cycle with the cover plate removed.
Figure 5:
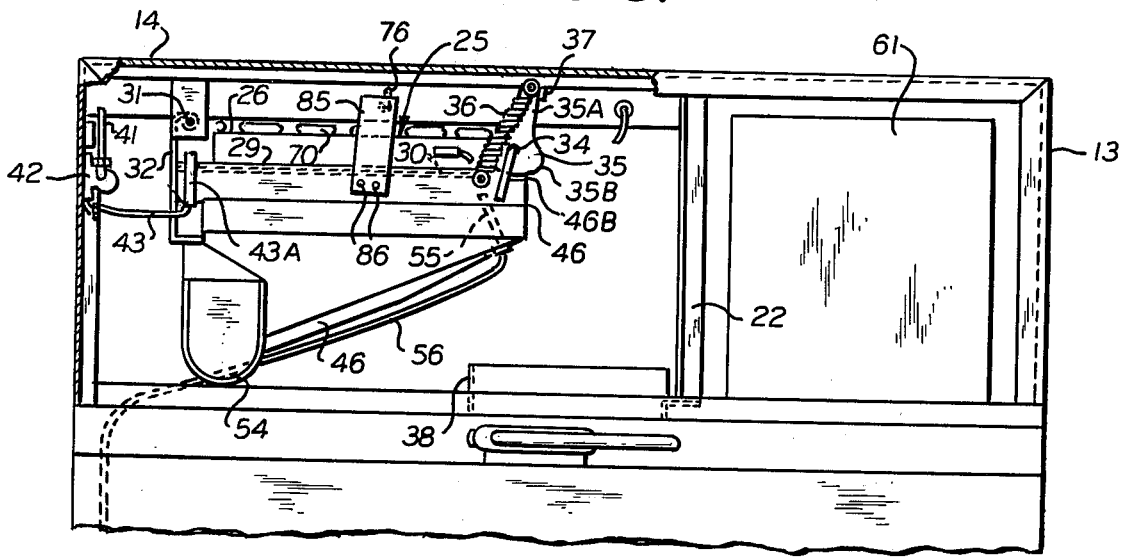
FIG. 5 is a view similar to FIG. 4, but showing the arrangement of the machine during the freezing cycle.

A closure plate or platen 29 is mounted in a frame 30, and is pivotally supported on pivot pin 31 by bracket 32, so that the platen 29 may be raised to a cell closing position during the freezing cycle of operation, as shown in FIGS. 3 and 5, or lowered during the harvest cycle of operation, as shown in FIGS. 2 and 4, to permit discharge of formed ice cubes from cells 28.

A platen moving motor 33 (shown in the schematic circuit wiring diagram of FIG. 9) is provided to raise and lower closure platen 29. The shaft 34 (FIGS. 2–5) of motor 33 which may be rotated either clockwise or counter-clockwise has link 35 fixedly connected to the end of shaft 34 and spring 36 is connected between the free end of line 35 and platen frame 30, as shown in FIGS. 2–5.

Clockwise rotation of platen motor shaft 34, as viewed in FIGS. 2–5, will cause platen fram 30 to pivot about pin 31 to raise platen 29 to close the open bottoms of cells 28. Spring 36 will be tensioned, as shown in FIG. 5, to resiliently maintain closure plate 29 tightly against the bottoms of partitions 27. The leading face 35A of links 35, as best seen in FIG. 5, is adapted to move the arm of a toggle switch 37 when link 35 is rotated to the position shown in FIG. 5.

Counter-clockwise rotation of shaft 34, as viewed in FIGS. 2–5 will cause link 35 to rotate counterclockwise to lower frame 30 to open the bottoms of cells 28. Cubes 39 released from cells 28 slide down plate 29 into chute 38 leading to bin 17. Extension bar 40 (FIG. 4) extends from link 35, to contact toggle switch 37 when the link is in the down position to move the arm of toggle switch 37 as described in more detail hereinbelow. Link 35 may be provided with a cam surface 35B which abuts against platen 20 to implement the opening of cells 28 after the ice cubes have been produced.

WATER SUPPLY

The ice making machine is provided with a water supply pipe 41 (FIGS. 4, 5 and 8) adapted to be connected to a source of water to provide the fluid necessary for the production of the ice. Water supply pipe 41 is connected through solenoid actuated valve 42 (FIGS. 4, 5 and 8) to a conduit 43 which discharges onto platen 29 through a header 43a. Thus, the water will flow over platen 29 and through holes 45 (FIG. 7) in the platen 29 into a water reservoir 46 which depends from frame 30. The leading edge 46A of reservoir 46 projects beyond plate 29 to form opening 46B therebetween, so that the water in addition to entering reservoir 46 through holes 45, will also enter the reservoir through opening 46B.

Figure 6:
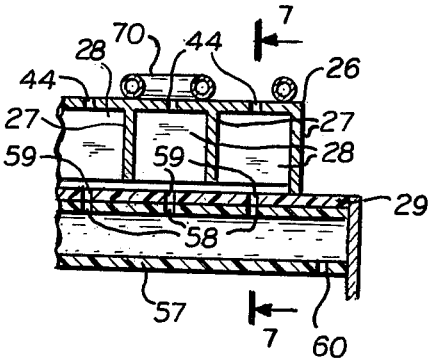
FIG. 6 is a fragmental detail sectional view through a cell of the freezing chamber with the parts in position during the freezing cycle.
Figure 7:
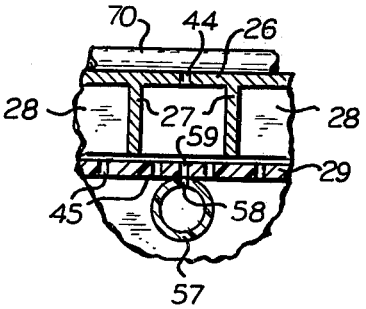
FIG. 7 is a detailed sectional view of the freezing chamber taken along line 7—7 of FIG. 6.

As shown in FIGS. 6 and 7, the evaporator plate 26 is provided with holes 44 leading to cells 28 to provide air vents for the cells.

Reservoir or water tank 46 is supplied with a predetermined volume of water prior to the actual freezing cycle. This water is recirculated through the freezing cells, as noted below, until the ice is formed. The volume of water introduced into the tank is substantially equal to the amount of water required to produce the ice cubes, thereby eliminating the draining of excess water after the freezing cycle has been completed.

Prior to the initiation of the freezing cycle, water is allowed to flow into tank 46 when the tank is in the down position. Water quantity in tank 46 is limited by overflow tube 55 in tank 46 which communicates with drain tube 56 connected to a drain external of the machine. Thus, water will flow into tank 46 until the level reaches the top of tube 55 at which time the water will overflow into drain tube 55 thereby assuring that the water in the tank remains at a predetermined level, which preferably corresponds to the exact volume of water required to produce ice in cells 28. It is to be noted that the front wall 46A of tank 46 extends substantially above tube 55 when the tank is in the down position to assure that water is retained in the tank 46 during the filling operation.

A water pump 54 (see FIG. 5) is connected to tank 46 and includes an inlet which communicates with the bottom of tank 46. The outlet of pump 54 is connected to water supply tubes 57 (FIG. 7) which extend beneath plate 29. Each of the water supply tubes 57, as shown in FIGS. 6 and 7, is provided with apertures 58 which are in alignment with corresponding apertures 59 in the platen 29. It is to be noted that a plurality of such apertures 58 and 59 are provided and they are spaced so that each aperture pair 58 and 59 will be approximately centrally located in the bottom of a cell 28 when the platen is in the cell closing position.

When pump 54 is operating, water will be pumped into the tubes 57 and through apertures 58 and 59 into the cells 28. Thus, the water will spurt up through platen 29 and will be formed into ice on the walls of cells 28. The water which is not immediately frozen will fall through holes 45 in platen 29 back into tank 46 to be recirculated again. Thus, the water in tank 26 will be recirculated until frozen into ice cubes. The ends of pipes 57 are provided with radially extending apertures 60 (FIG. 6) so that the water which does reach cells 28 will fall back into the tank 46.

REFRIGERATION SYSTEM

Figure 8:
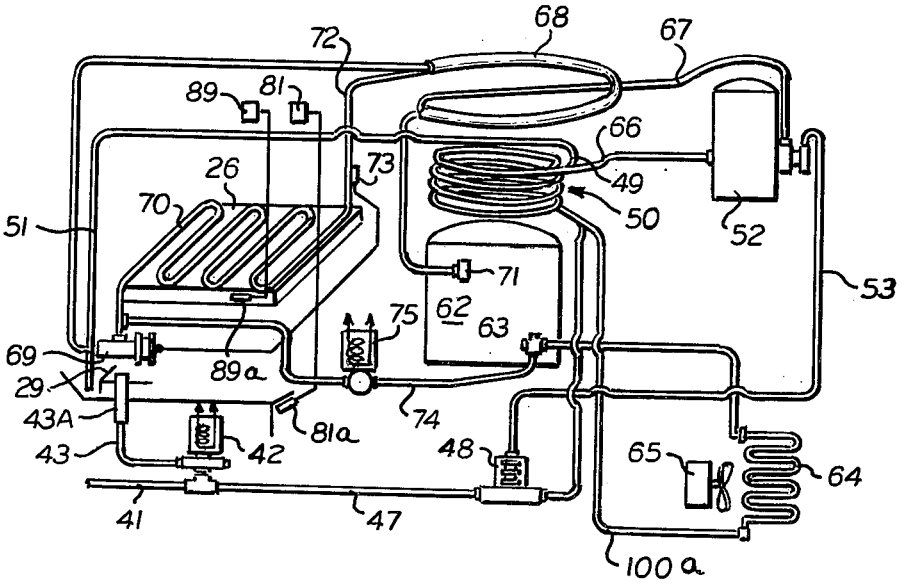
FIG. 8 is a schematic diagram of the refrigerant and water circulation systems used in the machine shown in FIG. 1.

The refrigeration system of ice making machine 10 is illustrated in schematic form in FIG. 8.

A preliminary refrigerant cooler is provided by water supply pipe 41 as best seen in FIG. 8, connected through line 47 and pressure control valve 48 to jacketed coil 49 in heat exchanger 50. Water flowing through coil 49 is discharged through an outlet tube 51 into the drain of the machine (not shown). As is conventional, the operation of valve 48 is dependent upon refrigerant pressure and is connected to a refrigerant reservoir 52 through a pressure control line 53. Thus, valve 48 will open and supply cold water to cooler 50 when the refrigerant pressure in control line 53 reaches a pre-set limit.

The compressor portion of the system is designated generally by the numeral 61 in FIGS. 2–5. As shown in FIG. 8, the compressor portion 62 comprises a compressor 62 which compresses the gaseous refrigerant and feeds it through compressor outlet 63 to a condensing coil 64. Fan 65, contained in compressor compartment 24 is positioned to blow air across the condensing coil 64 in a conventional manner. The refrigerant, which leaves condensing coil 64 and a liquid, flows through pipe 100a and heat exchanger 50 to remove heat from the refrigerant. Refrigerant pipe 66 connects heat exchanger 50 to an inlet on the refrigerant reservoir 52. As is conventional in machines of this type, a line 67 extends from the outlet of reservoir 52, through a heat exchanger 68 and an expansion valve 69 to a serpentine evaporator coil 70 which is mounted on the top plate 26 of the evaporator unit. The refrigerant is returned to an inlet 71 on compressor 62 via a return line 72 which extends through the heat exchanger 68. Expansion valve 69 is controlled by a thermostat 73, located on the return line 72, in the conventional manner. Hot gas bypass pipe 74 extends from outlet 63 on compressor 62, through a hot gas solenoid actuated valve 75 to evaporator coil 70.

In operation, the liquified cooled refrigerant entering reservoir 52 will be fed to the expansion valve 69 through the heat exchanger 68. The expansion valve will supply the refrigerant to the evaporator coil 70 in a gaseous state which will cool the freezing compartment containing the cells 28, thereby producing the ice cubes. After the freezing cycle has been terminated, the solenoid actuated valve 75 will be operated to allow hot gases to enter the coil 70 to heat the freezing chamber and release the ice cubes therefrom. It is to be understood that after termination of the freezing cycle, the closure plate will have been lowered to allow the ice cubes falling thereupon to be dispensed from the freezing portion 11 of the machine 10.

CONTROL SYSTEM

Figure 9:
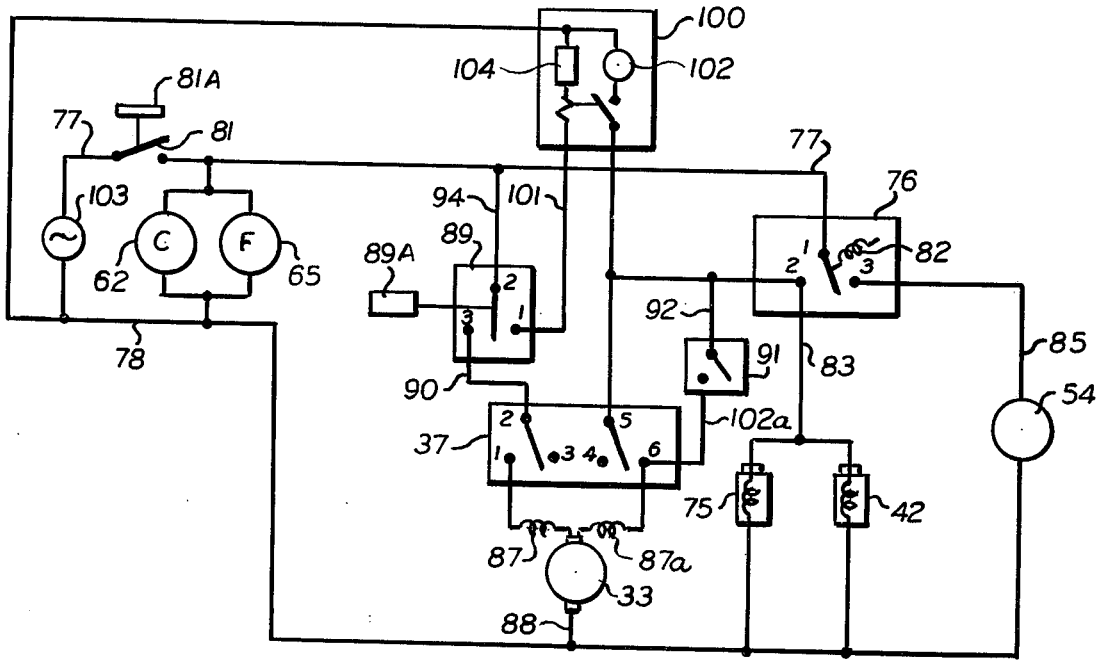
FIG. 9 is a schematic circuit wiring diagram of the control device of the present invention.

In accordance with the present invention, the control system, as illustrated in FIG. 9, includes leads 77 and 78 connected to a source of alternating current 103. The motors of compressor 62 and fan 65 are connected across leads 77 and 78 by respective leads 79 and 80. Lead 77 is connected to terminal 1 of a spring loaded pump actuating toggle switch 76. The switch arm of toggle switch 76 is connected to terminal 1 and is movable between terminals 2 and 3. A biasing spring 82 normally biases the armature of switch 76 into contact with terminal 3, thereby connecting terminals 1 and 2 together.

A thermostatically controlled bin switch 81 is serially connected in lead 77 between the source 103 and compressor 62 and fan 65. The thermostat 81A is located adjacent the top of bin 17 of the ice machine 10, and when the ice reaches the level of the thermostat 81A, the thermostat will be actuated to open switch 81 and prevent further operation of the machine until a sufficient amount of cubes have been removed from the bin to allow the thermostat to warm up.

Lead 83 connects terminal 2 of toggle switch 76 to solenoid actuated water valve 42, and solenoid actuated hot gas valve 75, which controls the flow of hot refrigerant gas to the evaporator coil 70. Water pump 54 is connected between terminal 3 of switch 76 by lead 85. Toggle switch 76 is actuated when frame 30 is moved up to the cell closing position.

Thus, a bracket 85 (FIGS. 4 and 5) is connected to frame 30 by screws 86 and is positioned so when the frame 30 is moved to the upper position, the top edge of the bracket 85 engages the arm of toggle switch 76 to thereby move the armature of toggle switch 76 to connect terminals 1 and 3 together. When frame 30 is lowered, biasing spring 82 will again cause terminal 1 to be connected to terminal 2.

Motor switch 37 comprises two double-throw toggle switches mounted on a common base. Terminal 2 is adapted to be connected to either terminal 1 or terminal 3 and terminal 5 is adapted to be connected to either terminal 4 or terminal 6. When the frame 30 is in the lower or ice harvesting position, motor switch 37 will be in a position such that terminals 2 and 5 will respectively be connected to terminals 1 and 4. When frame 30 is raised to the upper position, switch 37 will be actuated by edge **35*a* of link 35 to throw the armatures of the switches comprising motor switch 37 to the other position; whereupon terminal 2 will be connected to terminal 3, and terminal 5 will be connected to terminal 6. It is to be understood that when the frame is again lowered, the extension 40 will reset switch 37.**

Terminal 1 of switch 37 is connected to platen moving motor 33 through raising winding 87 of the motor which is connected to lead 78 by a lead 88. Terminal 2 of switch 37 is connected to a terminal 3 of the thermostatically actuated control switch 89 by a lead 90. Terminal 4 is unconnected. Terminal 6 of motor switch 37 is connected to lowering winding 87*a* of the platen motor 33. Lead 102*a* is connected between terminal 6 of toggle switch 37, through a normally open start-up toggle switch or push button 91, to lead 92 which connects to lead 83. Terminal 5 of motor switch 37 is connected to the opposite side of push button 91. Terminal 1 of switch 37 is unconnected.

When current flows through raising winding 87, motor 33 will be actuated to raise platen frame 30 and tank 46 so that the platen 29 seals the bottom of cells 28. When lowering winding 87*a* is energized simultaneously, the frame will remain in its lower position.

The thermostat bulb 89A of the thermostatically controlled switch 89 is located on the evaporator unit 25 of the ice machine. Switch 89 comprises three terminals respectively marked 1, 2 and 3 and includes an arm which is connected to terminal 2 and which is movable to complete a circuit between terminal 2 and either terminal 1 or to terminal 3. Thus, in practice, the terminal 2 is adapted to be connected to terminal 3 when the temperature of the evaporator unit reaches approximately 45° F. On the other hand, terminal 2 is adapted to be connected to terminal 1 when the temperature of the evaporator unit 25 is lowered to approximately 20° F. Terminal 2 is connected directly to lead 77 by a lead 94. As noted above, terminal 3 of the switch 89 is connected to terminal 2 of the motor switch 37 by the lead 90. Terminal 1 of thermostatic switch 89 is connected to timer 100 by lead 101.

The schematically illustrated timer 100 is a variable interval timer which is illustratively shown as a Deltrol timer such as manufactured by Deltrol Corporation of Milwaukee, Wisconsin, having a timer motor 102 and solenoid clutch 104. The timer 100 as shown is coupled into the control circuit with the thermostat 89 so that when the thermostat 89 makes the 2-1 circuit, the clutch 104 will be energized to activate the timer motor 102 and the timer will be energized to run through its preselected timing cycle.

OPERATION

In describing the operation of the machine, the description will commence with the initiation of operation upon installation of the machine.

The installer will be instructed to manually move the platen 29 down to the position shown in FIGS. 3 and 5. The bin thermostat 81A will sense no ice and hence switch 81 will be closed.

Thermostat 89A will sense no ice and switch 89 will be in the 2-3 position, completing the circuit to platen motor control switch 37 terminals 2 and 5.

The lowering of platen 29 will cause extension bar 40 (FIG. 4) to bring toggle switch 37 down to complete the circuit between terminals 2-1 and 5-4 of switch 37. Additionally, the downward movement of platen 29 will cause bracket 85 to move switch 26 to complete the circuit between switch terminals 1 and 2 of swtich 76, as a result of which normally closed water solenoid valve 42 will be energized to an open position permitting water to flow to reservoir pan 46.

The completion of the circuit between terminals 2-1 of switch 37 will energize the raising windings 87 of motor 33 before the requisite water is in the machine. To prevent this, normally open push-button switch 91 is operated to close the circuit to lowering winding 87*a* through a circuit from lead 77 through terminals 1-2 of switch 76, lead 92, push-button 91, and lead 102 to the lowering winding 87*a*, and return through lead 88. Thus, both field windings 87 and 87*a* will be energized to prevent the motor from operating 30 to the upper position. That is, when both field windings are energized, the weight of frame 30 and the elements connected thereto will maintain the plate in the lower position. The plate will also move to the lower position if both field windings are energized if the plate is in any intermediate position between the lower and the upper position or even in the upper position. Thus, the operator will maintain button 91 closed until the observes water flowing out of the overflow pipe 55, thereby signifying that the required volume of water has been received in tank 46. Thereupon, push-botton 91 may be released with the machine thereafter operating through its freezing, defrost, and harvest cycle.

Upon release of switch button 91, the normally open switch breaks the circuit to the lowering winding 87A, and the platen 29 and tank 46 now filled with water, will be raised to a position beneath the evaporator 25 closing cells 28 as seen in FIGS. 2 and 5.

When the platen frame 30 has been raised, toggle switch 76 will be actuated by bracket 85 to connect terminal 1 to terminal 2 of switch thereby breaking the connection between terminals 1 and 3 and de-energizing solenoids 42 and 75 to stop the flow of water and cut-off the hot gases flowing through evaporator coil 70. Additionally, motor switch 37 will be actuated by link 35 to connect terminal 2 to terminal 3 and terminal 5 to terminal 6.

Additionally, the raising of platen 29 causes toggle switch 36 to complete the circuit through terminals 1 and 2 of switch 76 to energize pump 54 to circulate the water in the system.

The compressor 62 is energized and as the refrigerant flows through evaporator coil 70, the temperature in unit 25 begins to decrease and the ice cubes form within cells 28.

Switch 89 will be actuated when the temperature reaches approximately 20° F., to break the 2-3 terminal connection and connect terminals 1 and 2 of the thermostatic control switch 89.

Though thermostat 89A is set to sense a temperature below freezing, in this case 20° F, it is found in practice that mere attainment of this freezing temperature does not of necessity insure freezing of all of the water in the cells 28, due to the turbulence of the water. Thus, in accordance with the invention, the freezing cycle is maintained for a manually selectable duration to insure desired freezing. The time is selected by the apparatus user and depends on factors such as ambient temperatures, and the physical and chemical nature of available water. However, all that the user must consider is how long it takes to obtain a satisfactory ice cube, manually adjusting the timer until this is obtained. Times of between 20 – 60 minutes at a thermostat setting of 20° F. have proven adequate.

In operation, when contacts 2-1 of thermostat switch 89 are closed, a circuit to timer 100 is completed. After the timer has run through its selected cycle, it completes the circuit to the lowering windings 87*a* of platen motor 33, and normally closed solenoid valves 42 and 75 will be energized through the circuit from the timer 100 to terminal 2 of switch 76 and lead 83 to solenoid valves 75 and 42 to open the valves 42 and 75.

Water has started to flow from the opened water fill valve 42 and through the header 43*a* onto the descending water plate, washing off any small particles of residual ice and directing the water down the plate and into the water tank as make up water for the next freezing cycle. The rate of water flow entering through the water fill valve is controlled by adjusting the orifice of the water valve flow. The now energized open hot gas valve is introducing the heated compressed refrigerant gas directly into the evaporator coils (bypassing the condenser 64 and expansion valve 69 as seen in FIG. 8) and warming the evaporator 25.

As the platen frame 30 is lowered, spring 82 of switch 76 biases the toggle to break the circuit to the water pump, providing an additional circuit through terminals 1-2 of switch 76 to energize solenoid valves 75 and 42.

When the platen 29 reaches the bottom of its movement to the position shown in FIG. 4, toggle actuation extension 40 moves the switch arms in switch 37 to make the circuit between terminals 2-1 and 5-6.

When thermostat 89A senses a temperature indicating that the cubes should be released, (e.g. a temperature of 40° – 45° F.), switch 89 will be actuated to complete the circuit between terminals 2 and 3, breaking the circuit between terminals 2-1.

The ice cubes drop from their cells 28 and fall over the surface of the platen 29 into bin 17.

In breaking the 2-1 contacts, the timer 100 circuit is broken, causing it to reset. The making of the 2-3 contacts energizes the raising windings 87 through terminals 2-1 of switch 37, and the platen 29 is raised.

When the platen 29 again closes against the cells, the toggles are again reset and the freezing cycle is again initiated.

It is thus seen that an ice making machine having a novel control system has been provided which elimates the pilot tank and double thermostatic arrangements heretofore used and the attendant inaccuracies in the freezing cycle which was associated with these devices and has substituted therefor a simple manually controlled accurate and economical timer thermostat control device for maintaining a freezing cycle of fixed duration.

The above disclosure has been given by way of illustration and elucidation and not by way of limitation, and it is desired to protect all embodiments of the herein disclosed inventive concept within the scope of the appended claims.

What is claimed is:

1. In an ice making machine having an ice forming enclosure, a refrigeration system having an evaporator in heat exchange relationship with said enclosure to cool said ice forming enclosure during the freezing cycle; valve means in said refrigeration system permitting the flow of hot refrigerant gas to said evaporator to heat said ice forming enclosure to harvest the ice therefrom during a harvest cycle; water supply means supplying water to said ice forming enclosure; and control means for automatically cycling the machine through freezing and ice harvesting cycles, said control means comprising: a thermostatic switch responsive to temperatures in said ice forming enclosure, a timer in an electrical circuit with said thermostatic switch and said valve means to discontinue freezing of ice and initiate the harvesting of ice after a given time interval, whereby the freezing cycle may be maintained for a period sufficient to insure freezing of water in said ice forming enclosure.

2. In an ice making machine as in claim 1 in which said timer is a manually controlled variable interval timer subject to selective adjustment by the user of the apparatus.

3. In an ice making machine as in claim 1 in which said thermostatic switch and timer are arranged in an electrical circuit controlling the operation of said valve means in said refrigeration system, permitting the flow of hot refrigerant gas to said evaporator.

4. In an ice making machine as in claim 1 having electrically operated valve means controlling the flow of water to said water supply means, in which said thermostatic switch and timer are arranged in a circuit with said valve means to control the flow of water to said ice forming enclosure in response to temperature conditions in said enclosure after a given time interval.

5. In an ice making machine as in claim 1 in which said timer is energized only after said thermostatic switch has sensed a temperature below freezing in said ice forming enclosure.

6. In an ice making machine machine as in claim 1 in which said thermostatic switch is operative to move between two circuit making conditions, one at a temperature of between 15° – 25° F. and the other at a temperature between 40° – 50° F.

7. In an ice making machine as in claim 2 in which said timer is adjustable between a timer interval of 20 – 60 minutes.

* * * * *